US007104493B2

(12) United States Patent
Fairchild

(10) Patent No.: US 7,104,493 B2
(45) **Date of Patent: *Sep. 12, 2006**

(54) DISPENSING APPARATUS AND METHOD

(75) Inventor: Michael A. Fairchild, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/463,481

(22) Filed: Jun. 16, 2003

(65) Prior Publication Data

US 2004/0149854 A1 Aug. 5, 2004

Related U.S. Application Data

(63) Continuation-in-part of application No. 10/359,521, filed on Feb. 5, 2003.

(51) Int. Cl.
*B65H 23/06* (2006.01)

(52) U.S. Cl. ..... 242/421.8; 242/421.9; 242/597.6

(58) Field of Classification Search ..... 242/421.8, 242/421.9, 423, 571.4, 571.5, 596.7, 597.6, 242/599.4; 188/24.11–24.13, 24.19, 24.22
See application file for complete search history.

(56) References Cited

U.S. PATENT DOCUMENTS 1,735,570 A 11/1929 Halliwell
2,231,140 A * 2/1941 Richardson ..... 242/599.2
2,623,703 A 12/1952 Laycock
3,292,874 A * 12/1966 Tinkham ..... 242/571.5
3,596,845 A * 8/1971 Rajnoha et al. ..... 242/571.4
4,566,785 A * 1/1986 Takenouchi ..... 355/72
4,752,044 A * 6/1988 Memminger et al. .... 242/365.7

(Continued)

FOREIGN PATENT DOCUMENTS

EP 1 004 528 5/2000

(Continued)

OTHER PUBLICATIONS

Weiss, Herbert L., *Control Systems for Web-Fed Machinery, A Guide to the Design, Selection and Usage of Hydraulic, Pneumatic and Electronic Control Systems for Web-Fed Machinery*, pp. 78-80, 82, 94, 95, 98, 99, 103, 105, and 106 (1983).

(Continued)

*Primary Examiner*—Kathy Matecki
*Assistant Examiner*—Sang Kim
(74) *Attorney, Agent, or Firm*—Klarquist Sparkman, LLP

(57) ABSTRACT

Various embodiments of an apparatus and method for dispensing elongated material, such as tape, from a spool or roll of such material are disclosed. In one embodiment, a dispenser includes a rotatable spindle for supporting the roll of material and a brake assembly operable to provide a braking force to the spindle. The brake assembly desirably includes a rotor coupled to the spindle and a caliper configured to apply a braking force to the rotor, thereby slowing or preventing rotation of the spindle. The spindle can include at least one roll retainer projecting radially outwardly from the spindle. The roll retainer is configured to frictionally engage an inner surface of a core of the roll to prevent movement of the roll relative to the spindle when material is being dispensed from the roll, yet allow an operator to remove the core from the spindle.

23 Claims, 7 Drawing Sheets

U.S. PATENT DOCUMENTS

| | | | | |
|---|---|---|---|---|
| 4,917,327 | A | 4/1990 | Asbury, Jr. et al. | |
| 5,029,768 | A | 7/1991 | Asbury, Jr. et al. | |
| 5,098,029 | A * | 3/1992 | McIntyre | 242/411 |
| 5,725,321 | A * | 3/1998 | Brannan et al. | 400/708 |
| 5,775,630 | A | 7/1998 | Hogberg et al. | |
| 6,092,789 | A | 7/2000 | Christopher et al. | |
| 6,164,421 | A * | 12/2000 | Nakamura et al. | 188/71.5 |
| 6,491,139 | B1 * | 12/2002 | Budica | 188/71.6 |
| 6,729,628 | B1 * | 5/2004 | Bellehumeur et al. | 280/11.215 |

FOREIGN PATENT DOCUMENTS

| | | |
|---|---|---|
| GB | 2185241 | 7/1987 |
| GB | 2 304 684 | 3/1997 |

OTHER PUBLICATIONS

European Search Report for corresponding European Patent Application No. EP 04708625, dated Apr. 20, 2006.

International Search Report for corresponding International Application No. PCT/US2004/003485.

Written Opinion of the International Searching Authority for corresponding International Application No. PCT/US2004/003485.

* cited by examiner

DISPENSING APPARATUS AND METHOD

CROSS-REFERENCE TO RELATED APPLICATION

This application is a continuation-in-part of U.S. application Ser. No. 10/359,521, filed Feb. 5, 2003, which is incorporated herein by reference.

FIELD

The present invention relates to embodiments of an apparatus and method for dispensing elongated material, such as tape, from a roll of the material.

BACKGROUND

Modern consumer and industrial packaging often includes reinforcing tapes or tear tapes as part of their construction. Various tape dispensers have been devised to dispense such tapes into corrugator and packaging equipment.

One such dispenser in disclosed in U.S. Pat. No. 4,917,327 to Asbury et al. The '327 patent discloses a system for automatically splicing together the trailing end portion of a spool, or roll, of tape to the leading end portion of a new spool of tape without interrupting the dispensing process. To prevent the tape from breaking under the strain caused by the inertia of the new spool of tape (which is initially at rest), the tape path is provided with a tension-control mechanism. In response to an increase in tension in the tape, the tension-control mechanism moves to shorten the length of the tape path, thereby relieving the increased tension in the tape. As the new spool comes up to speed, the tension-control mechanism, under the influence of a biasing mechanism, returns to its initial position to increase the path of the tape length. An active brake assembly prevents the new spool from unduly accelerating in response to the lengthening of the tape path by the tension-control mechanism.

Typically, tapes used for packaging are heat activated. In conventional dispensers, heat generated by the braking mechanism can be conducted to the roll of tape being dispensed, thereby possibly adversely affecting the dispensability of the tape. Thus, it would be desirable to limit the amount of heat generated by the braking mechanism that is conducted to the tape roll.

Accordingly, there is a continuing need for new and improved systems for dispensing tape.

SUMMARY

The present invention is directed to various embodiments of an apparatus and method for dispensing elongated material, such as tape, from a spool, roll or other wound overlapping configuration of such material.

In one representative embodiment, an apparatus for dispensing elongated material from a roll of material includes a rotatable spindle for supporting the roll of material and a brake assembly. The brake assembly includes a rotor coupled to the spindle and a caliper configured to apply a braking force to the rotor, thereby slowing or preventing rotation of the spindle. The brake assembly desirably is operable to change the braking force in response to a change in tension in the material being dispensed from the roll. A tension-control mechanism is movably coupled to the material being dispensed from the roll. The tension-control mechanism is mechanically coupled to the brake assembly to control the brake assembly to reduce the braking force in response to an increase in tension in the material being dispensed from the roll and to increase the braking force when there is a decrease in tension in the material.

In particular embodiments, the tension-control mechanism is movable in response to increased tension in the material to shorten the path of the material and movable in response to decreased tension in the material to lengthen the path of the material. The tension-control mechanism is also operatively coupled to the brake assembly such that the brake assembly reduces the braking force when the tension-control mechanism moves to shorten the path length of the material and to increase the braking force when the tension-control mechanism moves to lengthen the path length.

In another representative embodiment, an apparatus for dispensing elongated material from a roll includes a rotatable spindle for supporting the roll of material. At least one roll retainer projects radially outwardly from the spindle and extends at an angle with respect to the rotational axis of the spindle. The roll retainer frictionally engages an inner surface of a core of the roll to prevent movement of the roll relative to the spindle when material is being dispensed from the roll, yet allows an operator to remove the core from the spindle. In addition, when material is being dispensed from the roll, the roll retainer applies an axially directed force to the roll, causing the roll to bear against a stop on the spindle. In some embodiments, first and second roll retainers are positioned on generally diametrically opposite sides of the spindle. The roll retainers have respective core-engaging surfaces that extend generally helically with respect to the rotational axis of the spindle in the same direction.

In another representative embodiment, an apparatus dispenses tape from a first roll of tape supported on a first spindle and then from a second roll of tape supported on a second spindle. The trailing end portion of the first roll can be spliced to the leading end portion of the second roll to provide a continuous feed of tape. A first brake assembly comprises a first rotor and a first caliper. The first rotor is coupled to the first spindle and is rotatable therewith, and the first caliper is configured to apply a braking force to the first rotor, thereby retarding rotation of the first spindle. A second brake assembly comprises a second rotor and a second caliper. The second rotor is coupled to the second spindle and is rotatable therewith, and the second caliper is configured to apply a braking force to the second rotor, thereby retarding rotation of the second spindle. A tension-control mechanism is movably coupled to the tape from the first roll when tape is being dispensed from the first roll and to the tape from the second roll when the tape is being dispensed from the second roll. The tension-control mechanism controls the first brake assembly to change the braking force of the first brake assembly in response to a change in tension in tape being dispensed from the first roll. The tension-control mechanism also controls the second brake assembly to change the braking force of the second brake assembly in response to a change in tension in tape being dispensed from the second roll.

In certain embodiments, the first brake assembly applies a quiescent braking force to the first spindle and a second brake assembly applies a quiescent braking force to the second spindle. The braking force applied by each brake assembly can be selectively and independently adjusted without affecting the braking force of the other brake assembly.

In still another representative embodiment, a method of dispensing tape from a roll of tape supported on a rotatable spindle comprises activating a caliper to apply a braking force to a rotor coupled to the spindle. As tape is dispensed from the roll, the caliper reduces the braking force applied to the rotor in response to an increase in tension in the tape.

The foregoing and other features and advantages will become more apparent from the following detailed description of several embodiments, which proceeds with reference to the accompanying figures.

BRIEF DESCRIPTION ON THE DRAWINGS

DETAILED DESCRIPTION

As used herein, the singular forms "a," "an," and "the" refer to one or more than one, unless the context clearly dictates otherwise.

As used herein, the term "includes" means "comprises."

Figure 1:
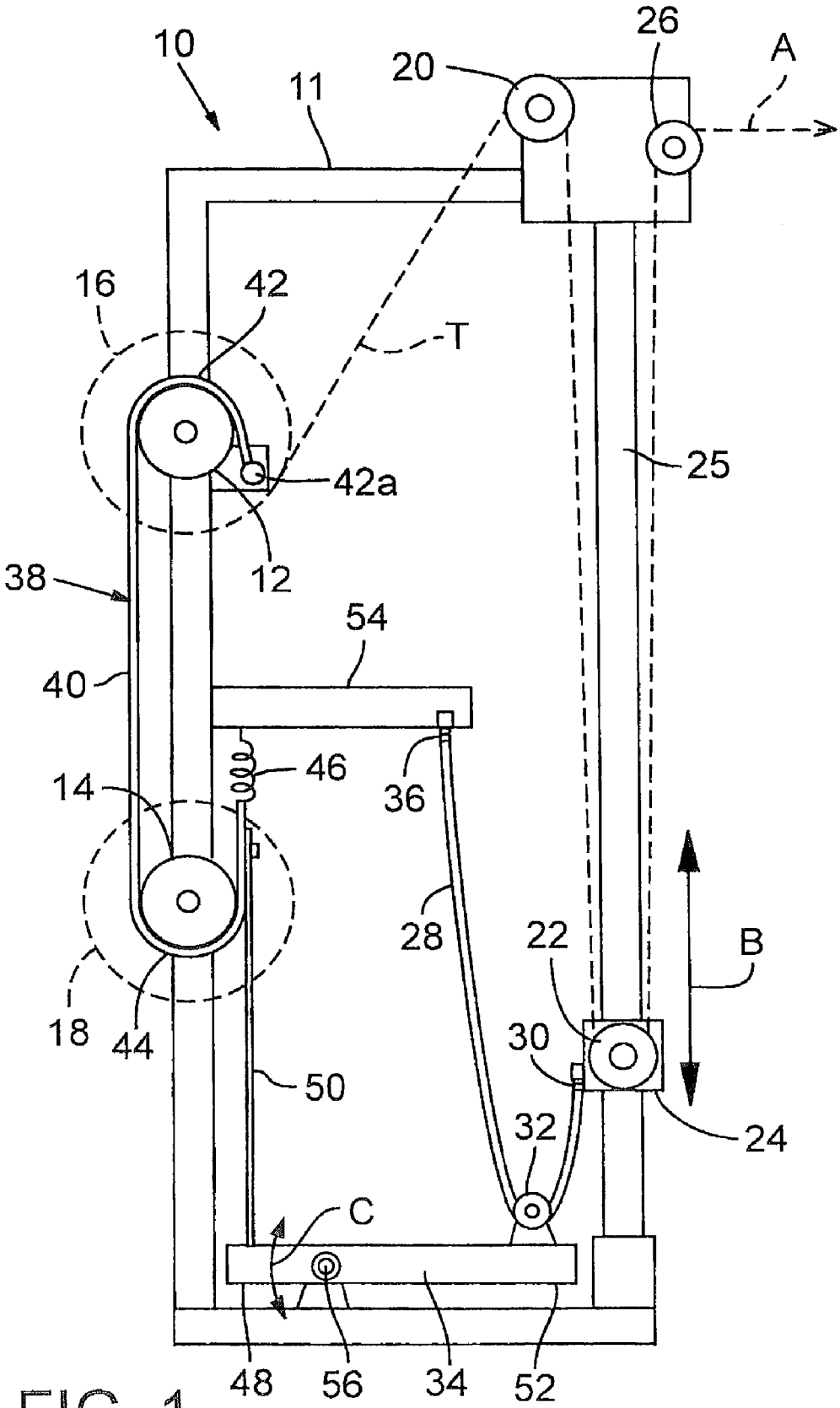
FIG. 1 is a schematic illustration of a dispensing apparatus according to one embodiment.

Referring to FIG. 1, there is shown a schematic illustration of a dispensing apparatus, indicated generally at 10, for dispensing elongated material from a roll, or spool, of the material. The embodiments of dispensing apparatus disclosed herein are preferably, but not exclusively, used for dispensing tape. Accordingly, the embodiments of dispensing apparatus disclosed herein can be used to dispense other types of elongated material from rolls, such as, paper, rope, fabric, or string, to name a few.

Apparatus 10 in the illustrated embodiment includes a frame 11. Mounted on the frame 11 for rotational movement are a first spindle 12 and a second spindle 14. The first spindle 12 supports a first spool of tape 16 and the second spindle 14 supports a second spool of tape 18. Tape T from one of the first and second spools 16, 18 is routed over a fixed roller 20, down to a tensioning roller 22 of a tension-control mechanism 24, and over a fixed roller 26, and then is fed to downstream equipment (e.g., corrugator or packaging equipment), as indicated by arrow A.

In the illustrated embodiment, apparatus 10 is shown dispensing tape from the first spool 16. When the tape from the first spool 16 is depleted, the trailing end portion of the tape from the first spool 16 can be spliced to the leading end portion of the tape from the second spool 18 to provide a continuous feed of tape. While tape is being dispensed from the second spool 18, another full spool of tape can be loaded onto the first spindle 12. The leading end portion of the tape from the new spool can then be spliced to the trailing end portion of tape from the second spool 18. This process can be repeated as necessary with any number of spools.

Any suitable splicing technique can be implemented in the embodiments of dispensing apparatus described herein to splice the trailing end portion of one spool of tape to the leading end portion of a succeeding spool of tape. For example, the automatic splicing technique described in the previously mentioned '327 patent to Asbury, which is incorporated herein by reference, can be used for splicing. As used herein, the phrase "automatic splicing" or "automatically splicing" refers to splicing operations in which the trailing end portion of a first spool is caused to splice to the leading end portion of a second spool while substantially maintaining the rate at which tape is supplied to downstream equipment.

The tension-control mechanism 24 (also referred to herein as a guide member in other embodiments) is movable in two directions (upwardly and downwardly, as indicated by double-headed arrow B, in the illustrated embodiment) along an upright rail 25 to vary the path length of the tape in response to changes in tension in the tape. The tension-control mechanism 24 is pulled downwardly by an elongated biasing member 28 and upwardly by the tension in the tape. Thus, when tape tension is high (i.e., when the current spool is providing tape slower than is required by downstream equipment, such as at the beginning of a spool), the tension-control mechanism is moves upwardly. The upward movement of the tension-control mechanism 24 shortens the tape path so that tape can be fed to downstream equipment without requiring the spool to dispense a corresponding length contemporaneously. Conversely, when tape tension is low (i.e., when the current spool is providing tape faster than is required by downstream equipment), the biasing member 28 causes the tension-control mechanism 24 to assume a lower position (as shown in FIG. 1) to increase the length of the tape path.

In particular embodiments, the biasing member 28 is a piece of elastic material, such as an elastic hose (e.g., surgical tubing), although other elastic materials can be used, such as an elastic band or equivalent devices. The illustrated biasing member 28 is reeved around a pulley 32 of a pivoted lever 34, and has a first end 30 connected to the tension-control member 24 and a second end 36 secured to an extension 54 of frame 11. Lever 34 is mounted for pivoting movement about a pivot pin 56, as indicated by double-headed arrow C.

A brake assembly 38 applies a controlled braking force to the first and second spindles 12, 14, respectively. The brake assembly 38 in the illustrated configuration includes a brake band 40 that extends about portions of spindles 12, 14 and serves to retard their rotation. An upper end portion 42 of the band 40 is affixed to frame, as at 42*a*, and therefore is stationary. A lower end portion 44 of the band 40 is coupled to extension 54 of frame 11 by a spring 46. Spring 46 exerts a biasing force on band 40 that causes the band to automatically apply a quiescent braking force to the spindles 12, 14. As used herein, the term "quiescent braking force" refers to a braking force applied to a spindle when the spindle is at rest. In the illustrated embodiment, for example, the spring 46 is a tension spring and is operable to pull upwardly on the lower end portion 44 of band 40 to cause the band 40 to tighten around spindles 12, 14. In alternative embodiments, such as the embodiment of FIG. 8 described below, a compression spring can be used to apply a braking force to the spindles. In addition, a biasing mechanism other than springs can be used to tension the brake band around the spindles. Such a biasing mechanism can include, for example, a piece of elastic material, such as an elastic band or hose, or any of various other elastic or resilient articles.

Other brake assembly configurations can be implemented in the dispensing apparatus. Alternative braking systems are described in detail below.

As shown in FIG. 1, the lower end portion 44 of band 40 is coupled to a first end portion 48 of the lever 34 by a connecting member 50. The brake assembly 38, lever 34, tension-control mechanism 24, and biasing member 28 cooperate to form a feedback mechanism, by which the brake assembly 38 applies a controlled braking force in response to changes in the tension in the tape. More specifically, when tape tension is high, the tension-control mechanism 24 travels upwardly, which in turn causes a second end portion 52 of the lever 34 to move upwardly and the first end portion 48 of the lever 34 to move downwardly. This movement is coupled to the brake assembly 38 by connecting member 50, which pulls against the spring 46, thereby reducing tension in the brake band 40 and causing a decrease in braking force so that the dispensing of tape can be accelerated. Conversely, when tape tension is lowered, the tension-control mechanism 24 travels downwardly under the biasing force of biasing member 28, which in turn allows the first end 48 of the lever 34 to move upwardly. This motion permits the spring 46 to reapply more tensioning force to the brake band 40, thereby causing a corresponding increase in the braking force to reduce the rate at which tape is being dispensed.

When the first spool 12 becomes depleted of tape, splicing the trailing end of the tape from the first spool 12 to the leading end of the tape from the second spool 14 will automatically bring the second spool 14 into action. The feedback mechanism serves to control the braking force in response to tension spikes that can occur during and immediately following splicing. For example, since the second spool 14 cannot immediately supply tape at the rate required by downstream equipment (due to the inertia of the second spool 14), the tension in the tape suddenly increases. The increased tension causes the tension-control mechanism 24 to move upwardly, which in turn causes the brake assembly 38 to reduce the braking force to allow rotation of the second spool 18. Also, the upward movement of the tension-control mechanism 24 shortens the tape path, thereby providing tape to the downstream equipment without requiring the second spool 14 to dispense a corresponding length contemporaneously.

As the second spool 18 accelerates to the required speed, the tension in the tape decreases, thereby allowing the tension-control mechanism 24 to be pulled downwardly by the biasing member 28. This movement activates the brake band 40, which applies a gradually increasing braking force on the second spindle 14 in response to the decrease in tape tension until equilibrium is established.

As a spool is dispensing tape, the diameter of the tape on the spool decreases. The feedback mechanism provided by the brake assembly 38, lever 34, tension-control mechanism 24, and biasing mechanism 28 compensates for the diametrical change of the spool by gradually decreasing the braking force to ensure substantially uniform tension throughout an entire roll. Without such a feedback system, the tension in the tape would increase in proportion to the change in radius of the spool from which the tape is dispensed.

If, following a splicing operation, the second spool 18 accelerates beyond the rate at which tape is being pulled by the downstream equipment, slack can form in the second spool 18. The slack can become stuck to the spool, entangled with the tape path, and/or cause tape breakage, which then requires a stoppage in production to fix the problem. This phenomenon is known as "overrun." Thus, to prevent such overrun of the second spool following a splice, the brake band must provide a braking torque sufficient to prevent the second spool 18 from accelerating beyond the rate at which tape is being pulled by the downstream equipment. It can be appreciated that increasing the rate at which tape is dispensed requires a corresponding increase in available braking torque to prevent over-acceleration of a spool following a splicing operation.

However, if the braking torque on a spindle is too high, the upward pulling force of the tension-control mechanism 24 (caused by an increase in tension) may not be sufficient to overcome the spring 46 to permit the spindle to accelerate to the required speed. Hence, the braking torque desirably should be great enough to prevent over-acceleration at a desired dispensing rate without adversely affecting the ability of the system to overcome the biasing mechanism (e.g., spring 46) that retards rotation of the spindles.

In the system disclosed in the '327 patent to Asbury, a maximum braking torque of about 21 in-lbs. typically is applied to the spindles, which is sufficient to permit splicing at dispensing rates of about 600 to 800 feet per minute while preventing overrun from occurring after splicing.

The embodiments of dispensing apparatus described herein allow for splicing at greater dispensing rates than prior systems. In particular embodiments, a brake assembly (e.g., brake assembly 38 or other brake assembly embodiments disclosed herein) is configured to apply a maximum braking torque of about 30 to 100 in-lbs., with 40 in-lbs. being a specific example. Embodiments having a braking torque of up to 100 in-lbs. have been found to permit splicing at dispensing rates up to about 1500 feet per minute. The ability to provide an increased braking torque is a consequence of coupling the biasing member 28 to the lever 34 via the pulley 32. More specifically, biasing member 28 pulls upwardly on the second end portion 52 of lever 34 when the tension-control mechanism 24 is pulled upwardly in response to an increase in tape tension. Since biasing member 28 is reeved around pulley 32, the pulling force of biasing member 28 on the lever 34 is greater than the upward pulling force that the tape exerts on the tension-control mechanism 24. In this manner, pulley 32 serves as a force multiplier for increasing the force (by about a factor of two) that is transferred to the lever 34 from the tension-control mechanism 24 by the biasing member 28. Hence, the mechanical advantage provided by the pulley 32 can be used to compensate for an increase in braking torque over prior systems.

Figure 2:
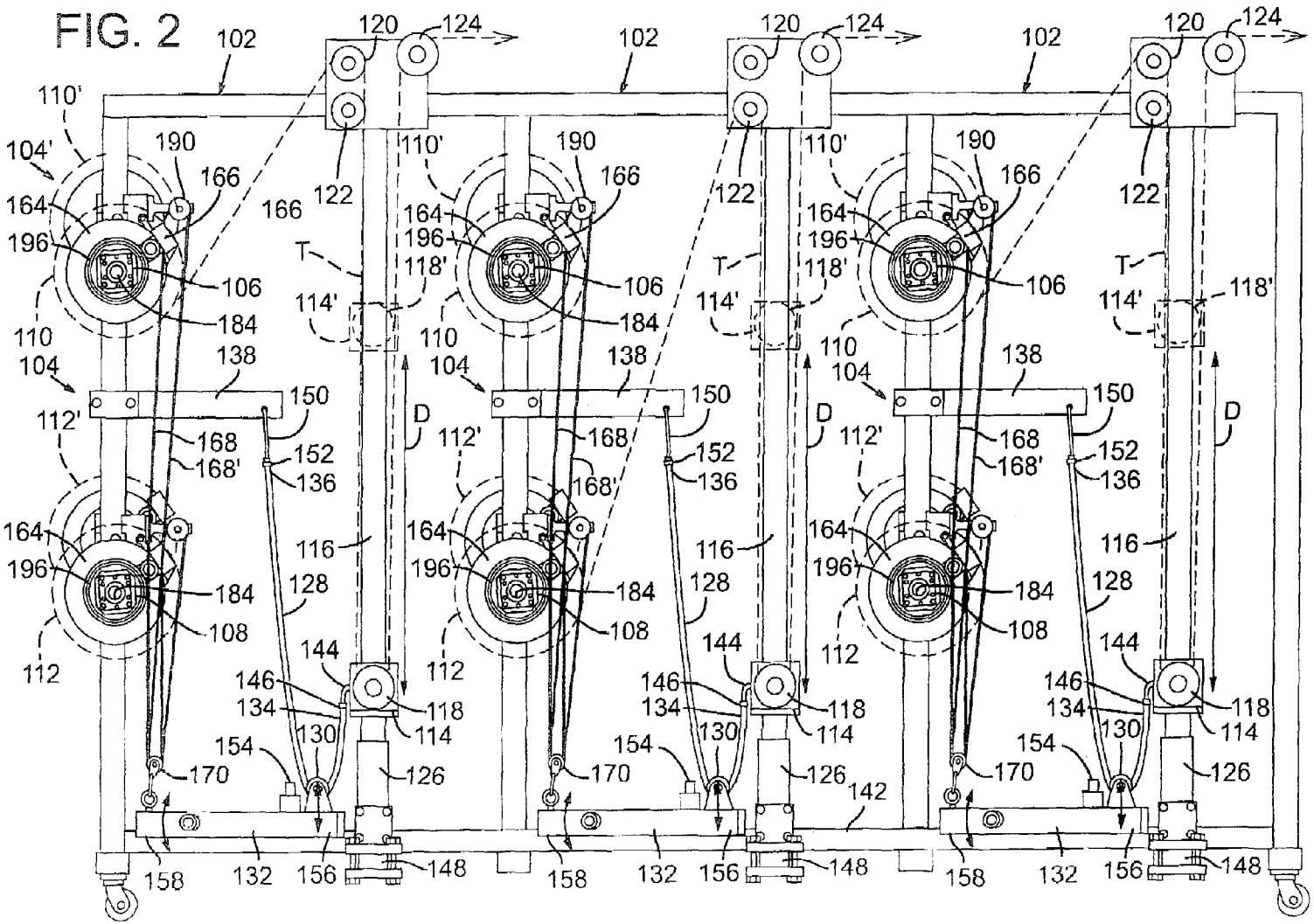
FIG. 2 is a side elevation view of a dispensing apparatus, according to one embodiment, for dispensing tape from multiple dispensers.

Referring now to FIG. 2, there is shown an apparatus 100 according to one embodiment for simultaneously dispensing tape from multiple rolls. Apparatus 100 includes a frame 102 on which there are mounted six tape dispensers constructed similarly to apparatus 10 shown schematically in FIG. 1. In the illustrated configuration, three such dispensers, indicated at 104, are mounted on one side of the frame 102, and three dispensers, indicated at 104', are mounted on the opposite side of frame 102 (which are generally hidden from view in FIG. 1). In alternative embodiments, apparatus 100 can have any number of dispensers 104, 104'. As best illustrated in FIGS. 4 and 5, each dispenser 104 is mounted in a side-by-side relationship with an adjacent dispenser 104'.

Figure 3:
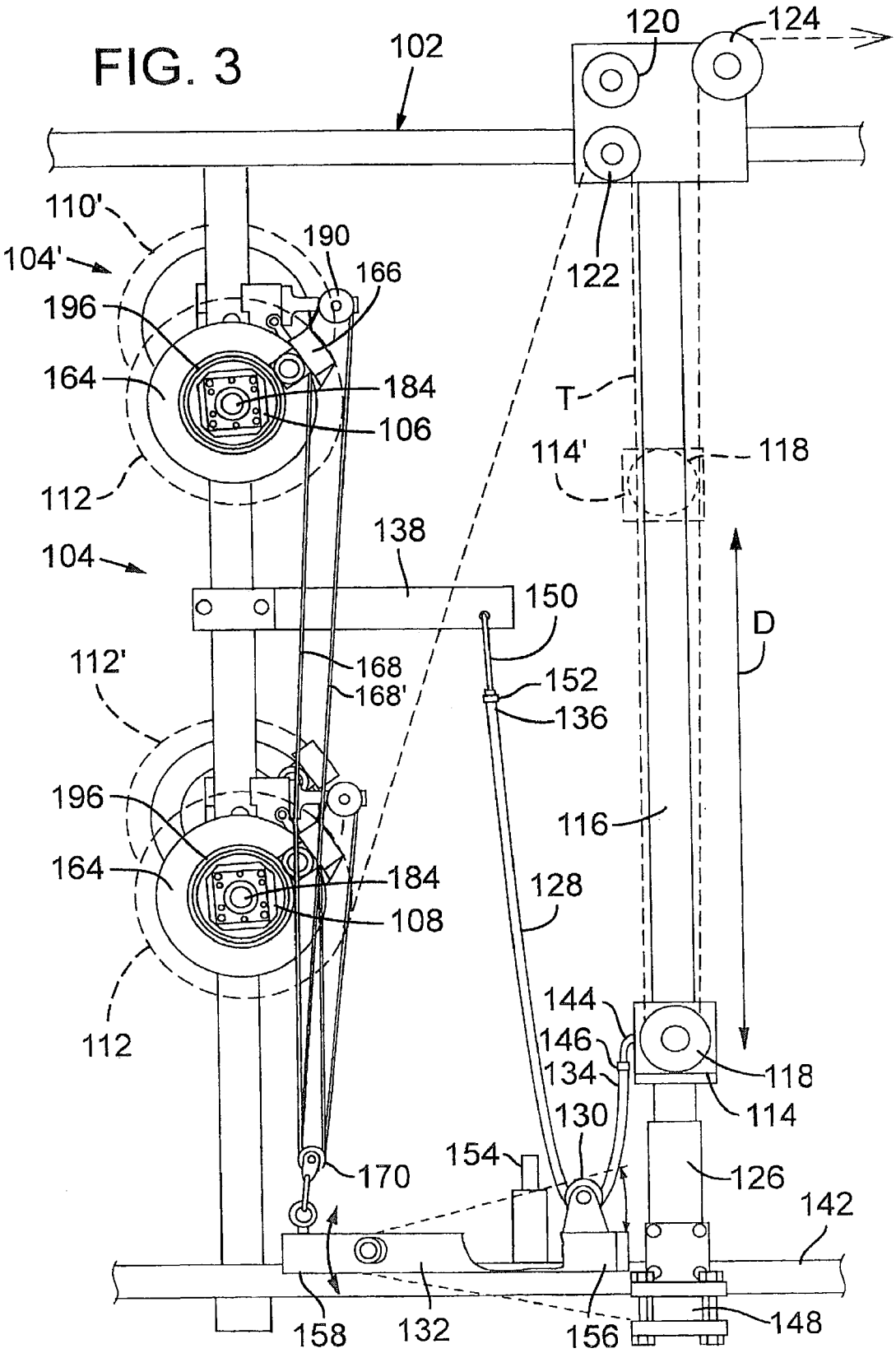
FIG. 3 is an enlarged side elevation view of one of the dispensers of the apparatus of FIG. 2.
Figure 8:
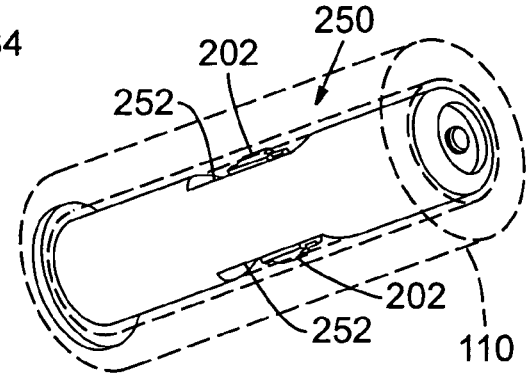
FIG. 8 is an enlarged, perspective view of another embodiment of a spindle.

Components of dispensers 104' that are identical to corresponding components of dispensers 104 are given the same respective reference numerals, except that the reference numerals for the components of dispensers 104' are followed by an apostrophe ('). As shown in FIGS. 2, 3, and 5, each dispenser 104 includes first and second rotatable spindles 106, 108, respectively, which can be rotatably mounted on respective shafts 184 (FIGS. 2 and 3) that are mounted the frame 102. As best shown in FIG. 5, each spindle 106, 108 in the illustrated embodiment has a generally square cross-section with curved surface portions 150 formed at the corners of the spindle and extending along the length thereof. However, the shape of the spindles is not limited to that shown in the illustrated embodiment. Accordingly, the spindles can have various other shapes or configurations, such as a generally cylindrical shape (FIG. 8).

The first spindle 106 supports a first spooi of tape 110 and the second spindle 108 supports a second spool of tape 112. The inboard end of each spindle 106, 108 desirably is formed with a stop 196 to prevent axial movement of a spool of tape in the inboard direction. Dispensers 104' have respective first and second spindles 106', 108' for supporting respective first and second spools 110', 112' on the opposite side of frame 102.

Figure 4:
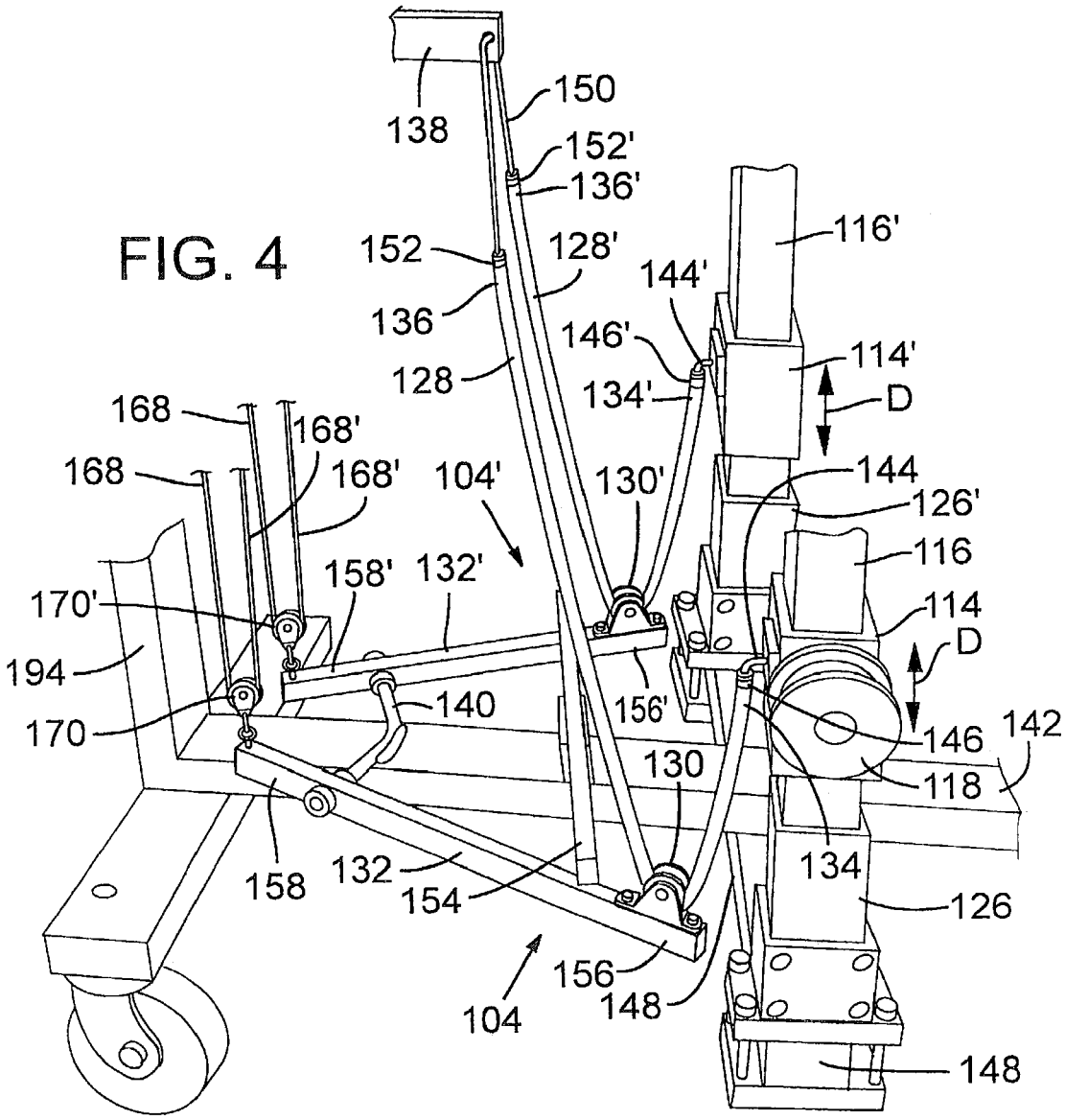
FIG. 4 is a perspective view of the bottom portion of two side-by-side dispensers of the apparatus of FIG. 2, as viewed from above.
Figure 5:
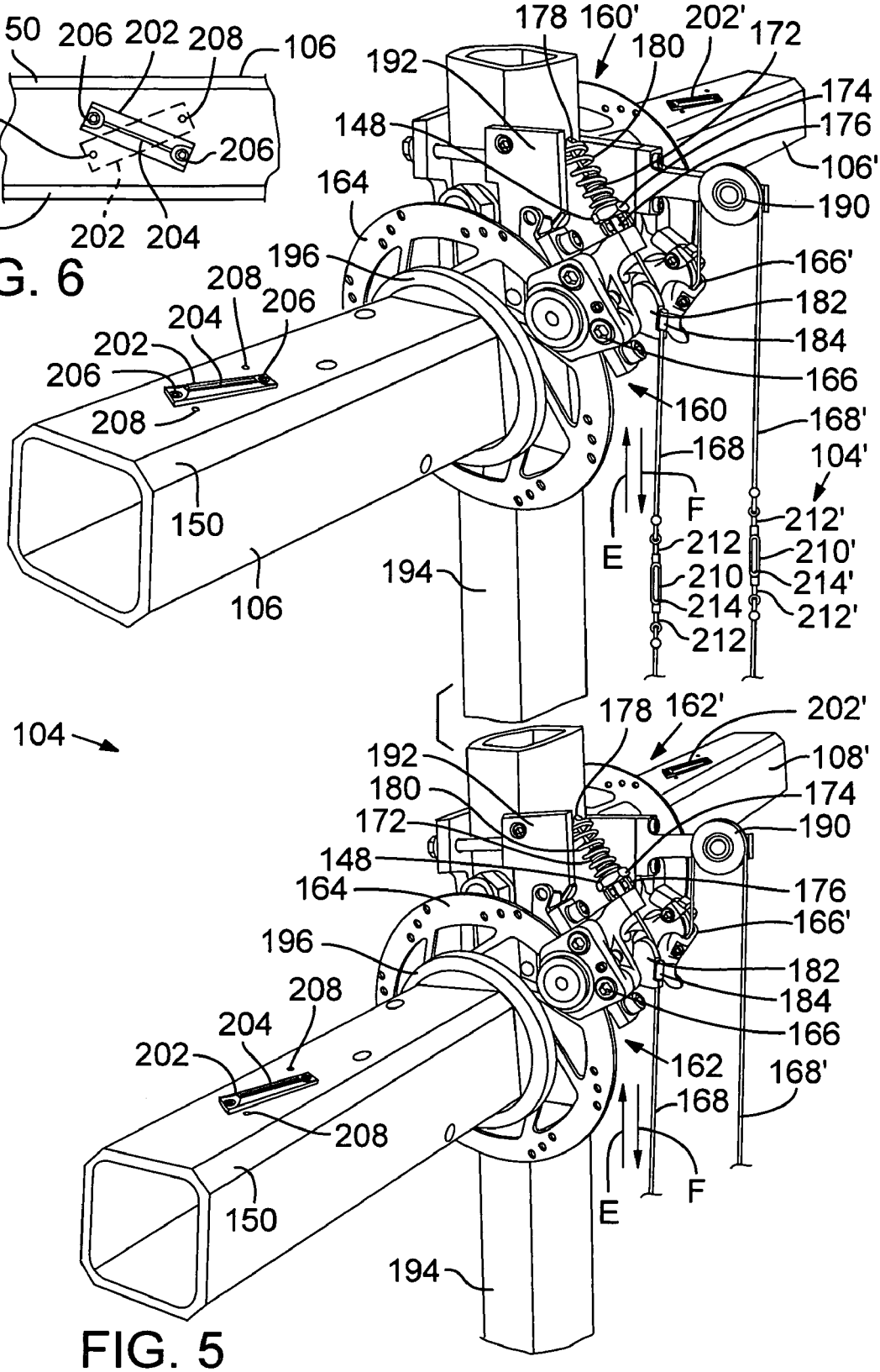
FIG. 5 is a perspective view of a portion of two side-by-side dispensers of the apparatus of FIG. 2, illustrating the upper and lower spindles and the brake assemblies of two side-by-side dispensers.

As best shown in FIG. 4, each dispenser 104, 104' also includes a respective tension-control mechanism 114, 114' that ride on respective upright rails 116, 116' extending between the top and bottom portions of the frame 102. As shown, each rail 116 of a dispenser 104 and rail 116' of an adjacent dispenser 104' in the illustrated embodiment are mounted on opposite ends of a transverse member 148 of frame 102. Tension-control mechanisms 114, 114' are movable upwardly and downwardly along their respective rails 116, 116', as indicated by double-headed arrow D in FIGS. 2–4. Each tension-control mechanism 114, 114' includes a respective tensioning roller 118, 118'.

As shown in FIGS. 2 and 3, tape that is dispensed from the first spool 110 of a dispenser 104 (e.g., the far left and far right dispensers 104 in FIG. 2) is routed over a respective fixed roller 120, down to a tensioning roller 118 of a respective tension-control mechanism 114, and over a respective fixed roller 124 to define a tape path T. Tape that is dispensed from the second spool 112 of a dispenser 104 (e.g., the center dispenser 104 in FIG. 2) can be routed over a respective fixed roller 122 mounted directly below fixed roller 120. Tape from the first spools 110 can be spliced to tape from respective second spools 112 to provide a continuous feed of tape from each dispenser 104. Although not shown, tape from each dispenser 104' can be reeved in the same manner over a respective tensioning roller 118' and a set of fixed rollers (not shown).

As best shown in FIG. 4, each rail 116, 116' in the illustrated configuration is elongated tubing having a square cross-section, although rails having other cross-sectional shapes also can be used. Stops 126, 126' (which can be a piece of rigid tubing) can be placed at the bottom of rails 116, 116' to limit the downward travel of tension-control mechanisms 114, 114'. Elastic biasing members 128, 128' (which can be elastic hose or tubing, such as surgical tubing) provide biasing forces for biasing tension-control mechanism 114, 114' downwardly against the tension in the tape. Biasing members 128, 128' have first ends 134, 134' coupled to tension-control mechanisms 114, 114' and second ends 136, 136' coupled to an extension 138 of frame 102, and are reeved around respective pulleys 130, 130'.

Biasing members 128, 128' can be coupled to tension-control mechanisms 114, 114', respectively, and to extension 138 in any suitable manner. As shown in FIG. 4, for example, the first ends 134, 134' of biasing members 128, 128' are placed on male inserts 144, 144' and secured with hose clamps 146, 146'. Second ends 136, 136' of biasing members 128, 128' are secured with hose clamps 152, 152' to opposite ends of a generally U-shaped rigid rod 150 that extends through extension 138. Rod 150 can be one piece or two separate pieces connected to each other at their ends. In other embodiments, other types of fasteners or connecting mechanisms can be used to secure the biasing members 128, 128' to tension-control mechanisms 114, 114' and to extension 138 or directly to the frame 102.

As shown in FIG. 4, pulleys 130, 130' are mounted on first end portions 156, 156' of respective pivoted levers 132, 132'. Each lever 132 of a dispenser 104 and lever 132' of an adjacent dispenser 104' are pivotally mounted on opposite ends of a common pivot pin 140. Pivot pin 140 is mounted to a longitudinal member 142 of frame 102 extending between the dispensers 104 and 104'. Lever 132 and lever 132' are configured to pivot independently relative to each other about pivot pin 140. In addition, an optional stop 154 can be mounted to member 142. The illustrated stop 154 extends over the first end portions 156, 156' of the levers to limit upward pivoting of first end portions 156, 156' when there is an increase in tape tension.

As best shown in FIG. 5, each dispenser 104 has first and second brake assemblies 160, 162, respectively, (which happen to be upper and lower brake assemblies in the illustrated embodiment) for providing a braking force to corresponding first and second spindles 106, 108, respectively. In the illustrated embodiment, the brake assemblies 160, 162 are mechanically coupled to a respective tension-control mechanism 114 (FIG. 4), as described below, to provide a controlled braking force to spindles 106, 108, respectively, in response to changes in tension in the tape. Each brake assembly 160, 162 in the illustrated embodiment includes a rotor 164 mounted to the inboard end of a respective spindle 106, 108 such that rotation of a spindle 106, 108 causes rotation of the respective rotor 164. Each brake assembly 160, 162 also includes a caliper 166 mounted at a fixed position relative a respective rotor 164. Each caliper 166 is operable to provide a braking force to a respective rotor 164, such as by clamping or squeezing the rotor between two surfaces of the caliper, as known in the art. Rotors 164 desirably are made of a material having low thermal conductivity, such as stainless steel, to minimize or eliminate the amount of heat that is generated during braking from being transferred to the rolls of tape on the spindles.

In the illustrated configuration, each dispenser 104 includes an elongated tension member 168, which is reeved around a pulley 170 connected to the second end portion 158 of a respective lever 132 (FIG. 4) and is coupled at its opposite end portions to calipers 166 of respective first and second brake assemblies 160, 162 (FIG. 5). Tension member 168 can be, for example, a conventional brake cable, such as used in a brake assembly of a bicycle. The calipers 166 are normally biased to exert a quiescent braking force to rotors 164. Movement of tension member 168 causes the calipers 166 to reduce the braking force applied to the rotors, as further described below.

As shown in FIG. 5, tension member 168 may include an in-line adjustment mechanism 210 to permit adjustment of the slack in the tension member. The illustrated adjustment mechanism 210 includes first and second threaded eye bolts 212 coupled at their adjacent ends by a threaded coupler 214.

As shown in FIG. 5, the end portions of tension member 168 are coupled to tension adjusters 148 (also referred to herein in other embodiments as brake adjusters) of the calipers 166. Each brake adjuster 148 is operable to adjust the quiescent braking of its respective brake assembly independent of any adjustment of the braking force of the other brake assembly of the same dispenser 104. Each tension adjuster in the illustrated configuration includes a threaded rod, or shaft, 172, on which there is disposed an adjusting nut 174 and a retaining nut 176, which serves to retain the adjusting nut 174 on the rod 172. Each rod 172 is formed with a longitudinally extending bore (not shown). The end portions of tension member 168 extend through the bores of rods 172 and are secured to respective caps, or retainers, 178. Interposed between each cap 178 and adjusting nut 174 is a compression spring 180. Each caliper 166 includes a pivoting or movable member 182 which is affixed to the tension member 168 at 184.

As can be appreciated by FIG. 5, pre-compression of a spring 180 causes the spring to exert a biasing force against a respective cap 178, which in turn pulls the tension member 168 in the direction indicated by arrow E in FIG. 5 (generally upwardly in the illustrated embodiment). Movement of tension member 168 in this direction causes movement of pivoting member 182 in a direction to cause the caliper 166 to apply a braking force to the respective rotor 164. Movement of tension member 168 in the opposite direction, as indicated by arrow F (generally downwardly in the illustrated embodiment), from downward pivoting of the second end portion 158 of lever 132 (FIG. 4), causes the caliper 166 to reduce the braking force on the respective rotor 164.

The maximum quiescent braking force applied by a braking assembly 160, 162 can be selectively adjusted by adjusting the position of an adjusting nut 174 of the respective tension adjuster 148. For example, to increase the maximum braking force applied by a caliper 166, the adjusting nut 174 is rotated toward the cap 178 to further compress the spring 180. To decrease the maximum braking force applied by the caliper 166, the adjusting nut 174 is rotated in the opposite direction to allow the spring 180 to relax and reduce the biasing force exerted on the cap 178. In some applications, the brake assemblies 160, 162 are set to apply a maximum braking force of at least 30 in-lbs. to spools 106, 108, although other applications may call for greater or lesser braking force.

In alternative embodiments, other types of tension adjusters can be used to adjust the braking forces of the braking assemblies. For example, the end portions of the tension member 168 can be coupled to a tension spring or another type of biasing mechanism configured to exert a pulling force on the tension member 168. Although less desirable, in other embodiments, the adjustment feature of the tension adjuster can be optional. For example, in one embodiment, a brake assembly includes the tension adjuster shown in FIG. 5, but does not have an adjusting nut 174 to increase or decrease the biasing force of the spring 180.

In particular embodiments, brake assemblies 160, 162 can be conventional caliper and rotor assemblies, such as used in the braking system of a bicycle, although modified to include the tension adjusters 148. One example of a caliper and rotor assembly that can be used is a Shimano Deore BR-M515 caliper and rotor assembly, available from Shimano American Corporation of Irvine, Calif.

As shown in FIG. 5, each dispenser 104' has similarly configured first and second brake assemblies 160' and 162', respectively, and a tension member 168' for applying a braking force to respective spindles 106', 108'. In the illustrated embodiment, the first and second brake assemblies 160', 162' of each dispenser 104' are mounted in an "upside down" position, as shown in FIG. 5, to allow brake assemblies 160', 162' to be mounted in close proximity to adjacent brake assemblies 160, 162. Because the brake assemblies 160', 162' are mounted in this manner, the end portions of tension member 168' are reeved around pulleys 190 (FIG. 5) before being routed down to pulley 170' (FIG. 4). In other embodiments, however, brake assemblies 160', 162' can be mounted in the same position as brake assemblies 160, 162. As further shown in FIG. 5, the caliper 166 of each brake assembly 160, 162 can be commonly mounted on a mounting bracket 192 with a caliper 166' and pulley 190 of an adjacent brake assembly 160', 162'. Mounting brackets 192 desirably are configured to be mounted to and removable from an upright support member 194 of the frame 102.

Dispensers 104, 104' operate in a manner similar to the embodiment shown in FIG. 1. For example, an increase in tape tension causes the end portion 158 of a lever 132 (FIG. 4) to pivot downwardly, which pulls the respective tension member 168 downwardly against the biasing force of each spring 180. Since the tension member 168 is coupled to both the first and second brake assemblies 160, 162, this movement simultaneously reduces the braking force of both the first and second brake assemblies 160, 162 (FIG. 5). Stop 154 (FIG. 4) limits upward pivoting of end portion 158 of the lever 132 to protect the brake assembly from excessive forces when there is an increase in tape tension. Conversely, a decrease in tape tension permits the end portion 158 of lever 132 to pivot upwardly, thereby reducing downward tension in tension member 168. This allows the spring 180 of each tension adjuster 148 to expand, thereby resulting in an increase in braking force applied to the spindles 106, 108. Hence, tension-control mechanism 114, elastic member 128, and brake assemblies 160, 162 cooperate to form a feedback mechanism to provide a controlled braking force in response to changes in tape tension.

While the illustrated embodiment shows the brake assemblies 160, 162 being mechanically coupled to a respective tension-control mechanism 114, other techniques can be implemented to operatively connect the brake assemblies to a tension-control mechanism. In one embodiment, for example, the tension-control mechanism can comprise an electric sensor, such as a load cell, that is operable to sense changes in tension in tape and send a feedback signal to a brake assembly.

In another embodiment, the brake assemblies 160, 162 of each dispenser 104 can be operatively connected to separate tension-control mechanisms, rather than a single tension-control mechanism. In addition, other forms for the tension-control mechanism can be implemented in the embodiments disclosed herein. For example, the tension-control mechanism can comprise a pivotable lever or arm that is coupled to the tape being dispensed. The arm pivots in response to changes in tension in the tape to control a brake assembly.

Brake assembly 160 is advantageous in that most of the heat generated by the brake assembly is either contained in the rotor 164 or dissipated to the surrounding air. Consequently, the amount of heat generating during braking that is transferred to the rolls of tape is substantially reduced or eliminated.

In a modification to the embodiment shown in FIGS. 2–5, each brake assembly 160, 160' and 162, 162' is coupled to a respective lever 132, 132' by a separate tension member that is connected to a respective tension adjuster 148, 148' at one end and to a respective lever 132, 132' at the opposite end. Thus, in this embodiment, each dispenser 104, 104' has two tension members (one for each brake assembly) and pulleys 170, 170' are not used.

While the brake assemblies of FIGS. 2–5 use a rotor and caliper arrangement, other types of brake assemblies also can be used, such as drum and shoe brakes, cantilever brakes, magnetic brakes (e.g., magnetic hysteresis or magnetic particle brakes), or band brakes (e.g., as shown in FIGS. 1 and 8).

Figure 6:
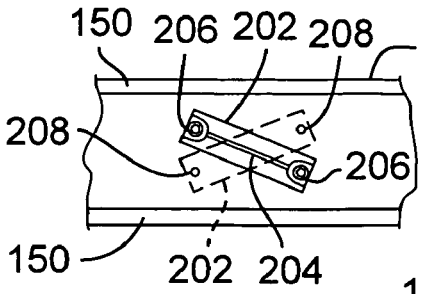
FIG. 6 is a plan view of a portion of a spindle showing the roll-grabbing mechanisms on the spindle for retaining a roll of tape on the spindle.

A roll of tape used in mechanized packaging processes typically comprises a rigid core made of cardboard or similar material and several thousand fee of tape wrapped around the core. Referring to FIGS. 5 and 6, each spindle 106, 108 desirably includes one or more roll-grabbing members (also referred to herein in other embodiments as roll retainers) 202 that frictionally retain the core of a tape roll on the spindle while tape is being dispensed, yet allow the core to be removed by an operator, such as when the core is depleted of tape. Each roll-grabbing member in the illustrated configuration is formed with a raised ridge 204 that serves as a core-engaging surface for engaging the inner surface of the core of the tape roll. The ridge 204 can be flat as shown, or alternatively, it can be formed with a plurality of grooves or teeth along its length. The roll-grabbing members are dimensioned such that when a core is placed on a spindle, ridges 204 score or otherwise deform the inner surface of the core, thereby creating a mechanical interface between the core and the ridges to resist movement of the core relative to the spindle.

In the illustrated embodiment, as shown in FIG. 6, each spindle has two roll-grabbing members 202 positioned on diametrically opposing sides of the spindle. Desirably, each roll-grabbing member 202 is skewed or positioned at an angle with respect to the rotational axis of its respective spindle, but in a reversed position with respect to an opposing roll-grabbing mechanism on the same spindle, such that the roll-grabbing members extend generally helically in the same direction with respect to the rotational axis, as illustrated in FIG. 6. When mounted in this position, the roll-grabbing members function in a manner similar to the threads of a helical screw with respect to the core of a tape roll to resist rotation of the core relative to the spindle. More specifically, as tape is being dispensed from a roll, the tension in the tape applies a torque acting to rotate the core of the tape roll relative to the spindle. The resistance of the roll-grabbing members 202 against the applied torque forces the core axially in the inboard direction against the stop 196, thereby preventing the core from rotating relative to the spindle and from backing off the spindle.

In the illustrated embodiment, the roll-grabbing members 202 are removable pieces that are secured to the spindles with screws 206 or other suitable fasteners extending into holes (not shown) formed in the spindle. As shown, additional holes 208 for receiving screws 206 can be formed in the spindles to allow the mounting position of each roll-grabbing member 202 to be reversed so as to change the direction of the "pitch" of the roll-grabbing members. By reversing the positions of the roll-grabbing members, the spindle can be rotated in the opposite direction.

In an alternative embodiment, the roll-grabbing members can be permanently mounted to a spindle, such as by welding, or they can be integrally formed in a spindle. In one implementation, for example, a spindle has a generally square cross-section with surface portions 150 at the corners of the spindle (as shown in FIG. 6) and one or more roll-grabbing members are machined into surface portions 150. In another embodiment, the roll-grabbing members can be a helical ridge formed along the length of the spindle so as to resemble the threads of a helical screw or bolt.

Figure 7:
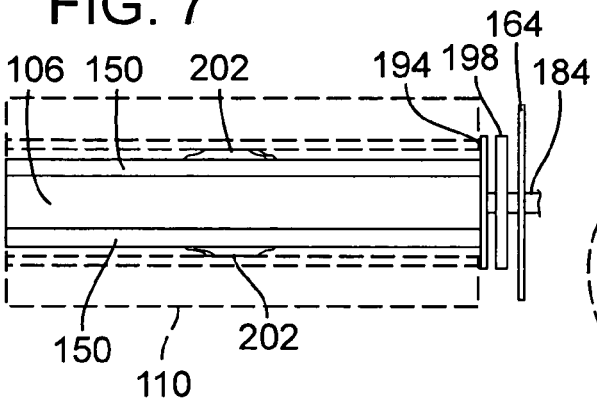
FIG. 7 is an enlarged, side elevation view of a spindle assembly according to another embodiment.

FIG. 7 illustrates the use of a heat sink 198 as a thermal barrier between a rotor 164 and a roll of tape (not shown) on a spindle 106. In this embodiment, the heat sink 198 is interposed between and axially spaced from the inboard end of the spindle 106 and the rotor 164 on a common shaft 184. The heat sink desirably is made of a material exhibiting good heat conductivity, such as copper, aluminum, or various other metals, alloys, or composite materials. In use, heat flowing from the brake assembly toward the roll of tape is collected by the heat sink 198 and dissipated into the surrounding air, thereby further reducing or eliminating the amount of heat that is transferred to the roll of tape during braking.

FIG. 8 illustrates another embodiment of a spindle, indicated at 250, that can be implemented in any of the embodiments of dispensing apparatus disclosed herein. Spindle 250 has a generally circular cross-section and is formed with one or more recessed portions 252. Desirably, spindle 250 has at least two recessed portions 252 formed on diametrically opposite sides of the spindle proximate the middle of the length of the spindle, as shown in FIG. 8. In addition, as shown in FIG. 8, a roll-grabbing member 202 desirably is mounted in each recessed portion 252 for retaining a core of a tape roll on the spindle in the manner described above.

Figure 9:
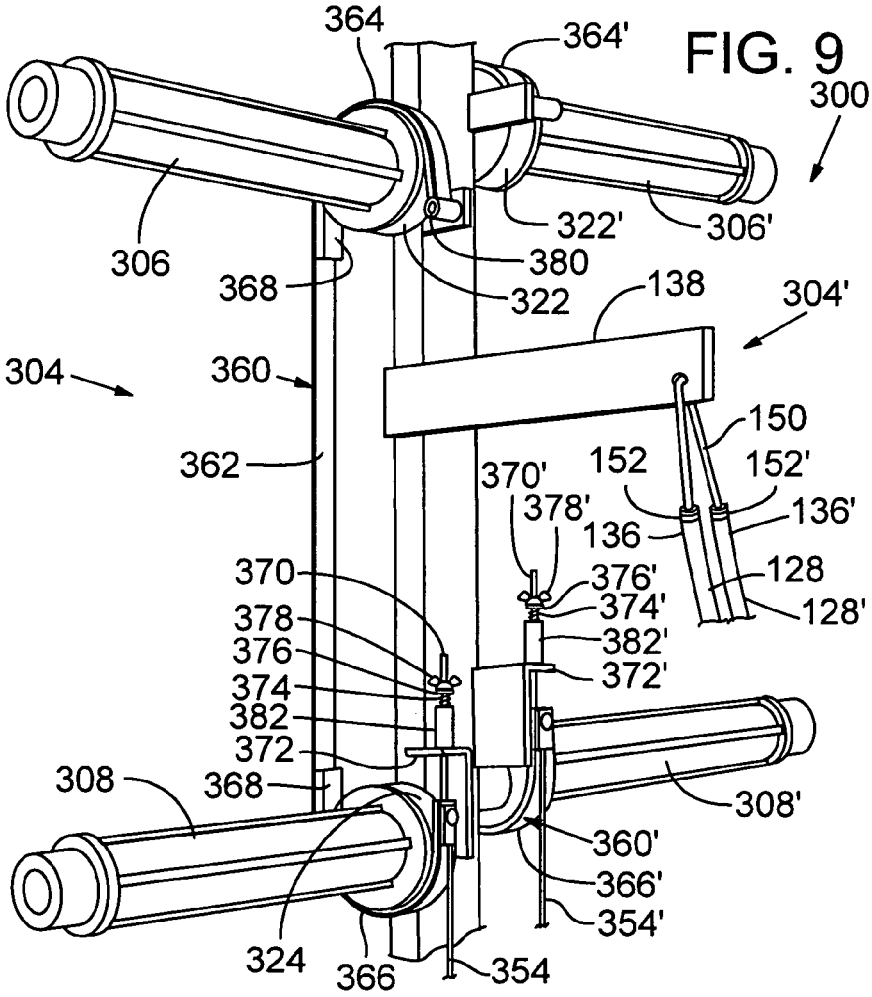
FIG. 9 is a perspective view of a portion of two side-by-side dispensers, according to another embodiment, illustrating the upper and lower spindles and the brake assemblies of the dispensers.
Figure 10:
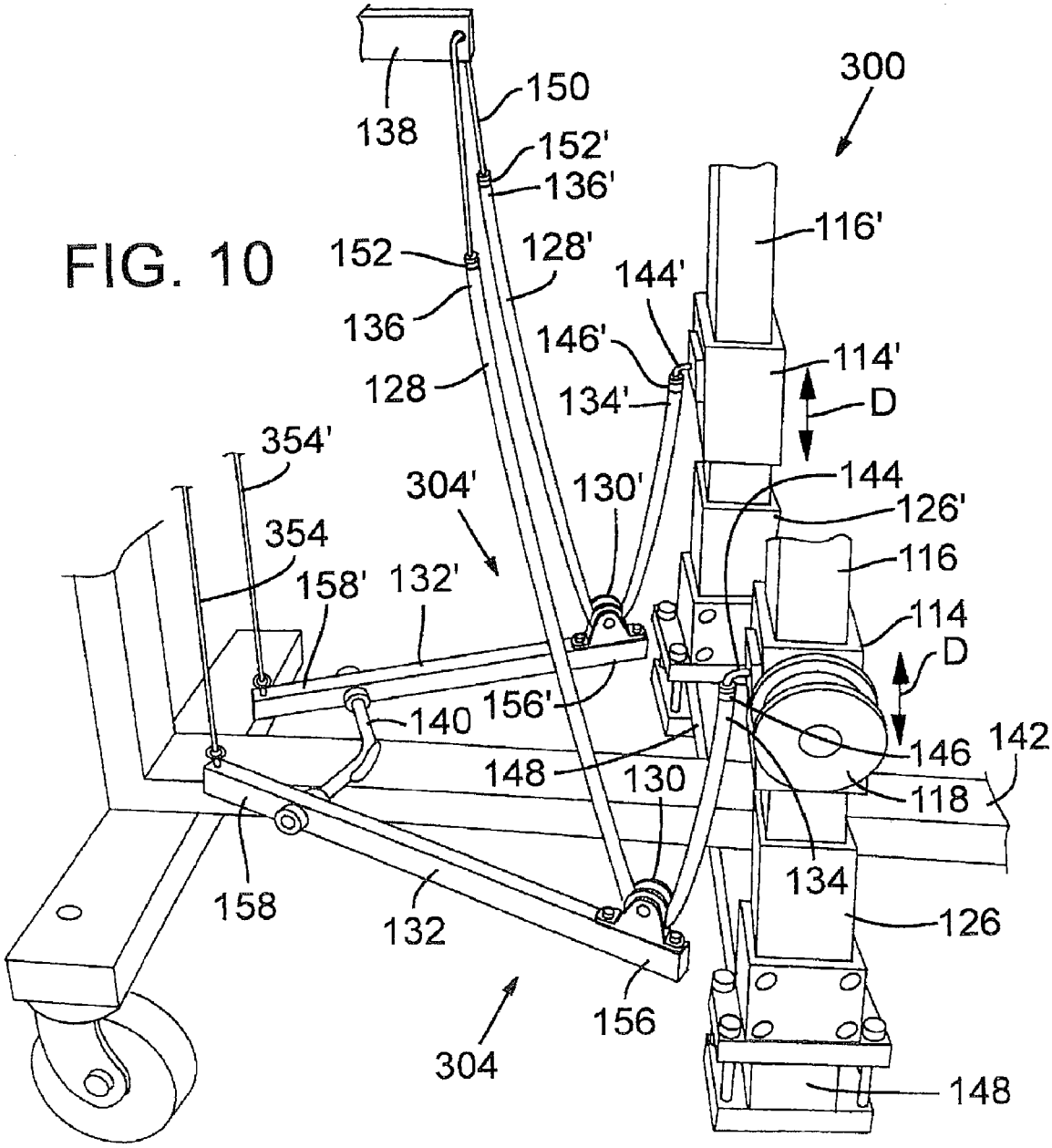
FIG. 10 is a perspective view of the bottom portion of the dispensers shown in FIG. 8.

FIGS. 9 and 10 illustrate another embodiment of an apparatus, indicated generally at 300, for dispensing tape or other types of elongated material. This embodiment shares many similarities with the embodiment shown FIGS. 2–5. Hence, components in FIGS. 9 and 10 that are identical to corresponding components in FIGS. 2–5 have the same respective reference numerals and are not described further.

Apparatus 300 generally comprises side-by-side dispensers 304, 304'. As shown in FIG. 9, dispenser 304 includes first and second spindles 306 and 308, respectively, and each dispenser 304' similarly includes first and second spindles 306' and 308', respectively. Although not shown, the spindles can include roll-grabbing members to assist in retaining rolls of tape thereon, such as shown in FIGS. 5–8.

Each dispenser 304 has a brake assembly 360 operatively connected to a respective biasing member 128 to provide a controlled braking force to spindles 306, 308 in response to changes in tension in the tape. Each brake assembly 360 in the illustrated embodiment includes a brake band 362 having an upper end portion 364 and a lower end portion 366. The upper end portion 364 extends about a portion of a rotor 322 mounted inboard of the first spindle 106 and is affixed to frame 302 with a bolt 380. The lower end portion 366 extends about a portion of a rotor 324 mounted inboard of the second spindle 108. The inner surfaces of upper end portion 364 and lower end portion 366 may be lined with a suitable brake lining material 368 (e.g., Scan-Pac 232 AF, available from Scan-Pac Manufacturing of Mequon, Wis.) for contacting the surfaces of rotors 322, 324.

In an alternative embodiment, rotors 322, 324 can be spaced axially from the inboard ends of spindles 306, 308, and a heat sink (e.g., heat sink 198 of FIG. 7) can be mounted between each rotor and spindle to reduce the amount of heat transferred to rolls of tape on the spindles during braking.

As further shown in FIG. 9, a threaded rod 370 is connected to lower end portion 366 of brake band 362 and extends upwardly through a bracket 372 on frame 302. A compression spring 374 is disposed around rod 370 and supported by bracket 372. A washer 376 and a nut 378 on rod 370 are tightened against the spring 374 to preload, or pre-compress, the spring. As can be appreciated by FIG. 9, pre-compression of spring 374 causes the spring to exert a biasing force that pulls upwardly on the lower end portion 366 of brake band 362, which in turn applies a braking torque to spindles 306, 308. In addition, a heat sink 320 can be positioned between each rotor 322, 324 and the corresponding spindle 306, 308 to dissipate heat generated during braking, thereby reducing or eliminating the amount of heat that is transferred to the rolls of tape (not shown in FIG. 8). Each dispenser 304' has a similarly configured brake assembly, which is shown partially in FIG. 9, for applying a braking force to respective spindles 306', 308'.

As shown in FIG. 10, dispensers 304, 304' have connecting members 354, 354' connected at their lower ends to the second end portions 158, 158' of levers 132, 132'. As shown in FIG. 9, connecting members 354, 354' are connected at their upper ends to the lower end portions 366, 366' of brake bands 362, 362'. In working embodiments, connecting members 354, 354' may be steel wires.

Dispensers 304, 304' operate in a manner similar to dispensers 104, 104' shown in FIGS. 2–5. For example, an increase in tape tension causes the end portion 158 of a lever 132 to pivot downwardly, which causes connecting member 354 to pull downwardly on the lower end portion 366 of a respective brake band 360 against spring 374. This movement reduces tension in the brake band to cause a reduction in braking force applied to spindles 306, 308. Conversely, a decrease in tape tension permits end portion 158 of lever 132 to pivot upwardly to allow spring 374 expand, thereby resulting in an increase in braking force applied to the spindles 306, 308.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

We claim:

1. An apparatus for dispensing elongated material from a roll of material, comprising:

a rotatable spindle for supporting the roll of material;

a brake assembly comprising a rotor and a caliper, the rotor being coupled to the spindle and being rotatable therewith, the caliper being configured to apply a braking force to the rotor, thereby slowing or preventing rotation of the spindle;

a tension-control mechanism being movably coupled to the material being dispensed from the roll, the tension-control mechanism being mechanically coupled to the brake assembly to control the brake assembly to reduce the braking force when there is an increase in tension in the material being dispensed and to increase the braking force when there is a decrease in tension in the material;

wherein the tension-control mechanism defines a portion of the path the elongated material is to follow, the tension-control mechanism being movable in response to increased tension in the material to shorten the path of the material and movable in response to decreased tension in the material to lengthen the path of the material;

wherein the tension-control mechanism is operatively coupled to the brake assembly such that the brake assembly reduces the braking force when the tension-control mechanism moves to shorten the path length of the material and to increase the braking force when the tension-control mechanism moves to lengthen the path length;

a pivoted lever having first and second end portions;

a resilient biasing member coupling the tension-control mechanism to the first end portion of the lever; and an elongated tension member coupling the brake assembly to the second end portion of the lever.

2. The apparatus of claim 1, wherein the elongated material comprises adhesive tape.

3. The apparatus of claim 1,, wherein the caliper is configured to automatically apply a quiescent braking force to the rotor, and to reduce the braking force in response to an increase in tension in the material being dispensed from the roll.

4. The apparatus of claim 3, wherein the brake assembly comprises a brake adjuster configured to adjust the quiescent braking force of the caliper.

5. The apparatus of claim 1, further comprising at least one roll-grabbing member protruding from the spindle and configured to frictionally engage an inner surface of a core of the roll, thereby retaining the roll on the spindle and preventing rotation of the roll relative to the spindle.

6. The apparatus of claim 5, wherein the spindle has a rotational axis and the at least one roll-grabbing member extends at an angle with respect to the rotational axis.

7. The apparatus of claim 6, further comprising a stop coupled to the spindle and wherein the at least one roll-grabbing member applies an axially directed force to the core causing the roll to bear against the stop when material is being dispensed from the roll.

8. The apparatus of claim 6, wherein the at least one roll-grabbing member comprises a first roll-grabbing member and a second roll-grabbing member positioned generally on diametrically opposite sides of the spindle.

9. An apparatus for dispensing elongated material from a roll comprising a core and material wrapped around the core, the apparatus comprising:

a rotatable spindle for supporting the roll of material, the spindle defining a rotational axis and having an outer surface that contacts an inner surface of the core when the roll is placed on the spindle; and at least one roll retainer projecting radially outwardly from the spindle and being skewed with respect to the rotational axis, the at least one roll retainer being configured to frictionally engage the inner surface of the core to prevent movement of the roll relative to the spindle when material is being dispensed from the roll, yet allow an operator to remove the core from the spindle;

wherein the at least one roll retainer applies an axially directed force to the core when material is being dispensed from the roll, the at least one roll retainer comprising a raised ridge formed with a plurality of teeth, defined by a plurality of grooves spaced along the length of the ridge, the teeth being adapted to score the inner surface of the core.

10. The apparatus of claim 9, wherein the spindle comprises a stop and said axially directed force to the core causes the core to bear against the stop when material is being dispensed from the roll.

11. The apparatus of claim 9, wherein the at least one roll retainer has a core-engaging surface that scores the inner surface of the core when the core is placed on the spindle.

12. The apparatus of claim 9, wherein the at least one roll retainer comprises a first roll retainer and a second roll retainer generally positioned on diametrically opposite sides of the spindle, each roll retainer extending in a straight line that is skewed with respect to the rotational axis of the spindle.

13. The apparatus of claim 9, further comprising a brake assembly for slowing or preventing rotation of the spindle.

14. The apparatus of claim 13, wherein the brake assembly comprises a rotor and a caliper, the rotor being coupled to the spindle and being rotatable therewith, the caliper being configured to apply a braking force to the rotor, thereby slowing or preventing rotation of the spindle.

15. An apparatus for dispensing tape from a first roll of tape and then from a second roll of tape, wherein the trailing end portion of the first roll is spliced to the leading end portion of the second roll to provide a continuous feed of tape, the apparatus comprising:

a first rotatable spindle for supporting the first roll of tape;

a second rotatable spindle for supporting the second roll of tape;

a first brake assembly comprising a first rotor and a first caliper, the first rotor being coupled to the first spindle and being rotatable therewith, the first caliper being configured to apply a braking force to the first rotor, thereby retarding rotation of the first spindle;

a second brake assembly comprising a second rotor and a second caliper, the second rotor being coupled to the second spindle and being rotatable therewith, the second caliper being configured to apply a braking force to the second rotor, thereby retarding rotation of the second spindle; and a tension-control mechanism being movably coupled to the tape from the first roll when tape is being dispensed from the first roll and to the tape from the second roll when the tape is being dispensed from the second roll, the tension-control mechanism controlling the first brake assembly to change the braking force of the first brake assembly in response to a change in tension in tape being dispensed from the first roll, the tension-control mechanism also controlling the second brake assembly to change the braking force of the second brake assembly in response to a change in tension in tape being dispensed from the second roll.

16. The apparatus of claim 15, wherein:

the first brake assembly is configured to apply a quiescent braking force to the first spindle, the first brake assembly being adjustable to adjust the quiescent braking force; and the second brake assembly is configured to apply a quiescent braking force to the second spindle, the second brake assembly being adjustable to adjust the quiescent braking force applied to the second spindle independent of adjusting the quiescent braking force applied to the first spindle.

17. The apparatus of claim 15, wherein:

the first spindle has at least one roll retainer projecting radially outwardly therefrom and configured to frictionally engage an inner surface of a core of the first roll so as to retain the first roll in a fixed position relative to the first spindle when material is being dispensed from the first roll;

the second spindle has at least one roll retainer projecting radially outwardly therefrom and configured to frictionally engage an inner surface of a core of the second roll so as to retain the second roll in a fixed position relative to the second spindle when material is being dispensed from the second roll.

18. The apparatus of claim 15, further comprising:

a pivoted lever having first and second end portions;

a biasing member coupling the tension-control mechanism to the first end portion of the lever;

a pulley connected to the second end portion of the lever; and an elongated tension member reeved around the pulley and having a first end coupled to the first caliper and a second end coupled to the second caliper.

19. The apparatus of claim 18, wherein the tension member comprises a cable.

20. An apparatus for dispensing elongated material, comprising:

a frame;

a first rotatable spindle for supporting a first roll of material, the first spindle being rotatably coupled to the frame and having at least one roll retainer for frictionally engaging an inner surface of a core of the first roll;

a second rotatable spindle for supporting a second roll of material, the second spindle being rotatably coupled to the frame and having at least one roll retainer for frictionally engaging an inner surface of a core of the second roll;

a first brake assembly comprising a first rotor and a first caliper, the first rotor being coupled to the first spindle and being rotatable therewith, the first caliper operable to apply a braking force to the first rotor;

a second brake assembly comprising a second rotor and a second caliper, the second rotor being coupled to the second spindle and being rotatable therewith, the second caliper operable to apply a braking force to the second rotor;

a first heat sink interposed between the first brake assembly and the first spindle, the heat sink operable to dissipate heat generated by the first brake assembly into the surrounding air;

a second heat sink interposed between the second brake assembly and the second spindle, the second heat sink operable to dissipate heat generated by the second brake assembly into the surrounding air;

a tension-control mechanism for defining a portion of the path the elongated material is to follow when dispensed from either the first or second rolls, the tension-control mechanism being movable in response to increased tension in the material to shorten the path of the material and movable in response to decreased tension in the material to lengthen the path of the material;

a pivoted lever having first and second end portions;

a biasing member coupling the tension-control mechanism to the first end portion of the lever;

a pulley mounted to the second end portion of the lever; and an elongated tension member reeved around the pulley and connected at one end portion to the first caliper and connected at another end portion to the second caliper.

21. An apparatus for dispensing elongated material from a roll comprising a core and material wrapped around the core, the apparatus comprising:

a rotatable spindle for supporting the roll of material, the spindle defining a rotational axis and having an outer surface that contacts an inner surface of the core when the roll is placed on the spindle; and at least one roll retainer projecting radially outwardly from the spindle and being skewed with respect to the rotational axis, the at least one roll retainer being configured to frictionally engage the inner surface of the core to prevent movement of the roll relative to the spindle when material is being dispensed from the roll, yet allow an operator to remove the core from the spindle;

wherein the spindle comprises at least one flat surface portion, the at least one roll retainer being mounted on the at least one flat surface portion of the spindle.

22. The apparatus of claim 21, wherein the spindle comprises a circular cross-section and is formed with at least one recessed portion defining the flat surface portion, the roll retainer being mounted on the flat surface portion within the recess.

23. An apparatus for dispensing elongated material from a roll comprising a core and material wrapped around the core, the apparatus comprising:

a rotatable spindle for supporting the roll of material, the spindle defining a rotational axis and having an outer surface that contacts an inner surface of the core when the roll is placed on the spindle; and at least one roll retainer projecting radially outwardly from the spindle and extending at an angle with respect to the rotational axis, the at least one roll retainer being configured to frictionally engage the inner surface of the core to prevent movement of the roll relative to the spindle when material is being dispensed from the roll, yet allow an operator to remove the core from the spindle;

wherein the spindle comprises at least one flat surface portion, the at least one roll retainer being mounted on the at least one flat surface portion of the spindle;

wherein the spindle comprises a generally square cross-section.

* * * * *

UNITED STATES PATENT AND TRADEMARK OFFICE

CERTIFICATE OF CORRECTION

PATENT NO. : 7,104,493 B2
APPLICATION NO. : 10/463481
DATED : September 12, 2006
INVENTOR(S) : Michael A. Fairchild et al.

It is certified that error appears in the above-identified patent and that said Letters Patent is hereby corrected as shown below:

On the Title page: Item (75)

Inventor -- Matthew Groves -- should be listed

Column 7, line 17 “spooi” should read -- spool --

Signed and Sealed this

Seventh Day of August, 2007

JON W. DUDAS
*Director of the United States Patent and Trademark Office*